US007086624B2

(12) United States Patent
Zaglio

(10) Patent No.: US 7,086,624 B2
(45) Date of Patent: Aug. 8, 2006

(54) SEPARATED YARN COILS ACCUMULATOR-FEEDER

(75) Inventor: Sergio Zaglio, Castiglione delle Stiviere (IT)

(73) Assignee: Man Socks Italia S.r.l. (IT)

( * ) Notice: Subject to any disclaimer, the term of this patent is extended or adjusted under 35 U.S.C. 154(b) by 0 days.

(21) Appl. No.: 10/503,912

(22) PCT Filed: Feb. 17, 2003

(86) PCT No.: PCT/IT03/00084

§ 371 (c)(1),
(2), (4) Date: Aug. 5, 2004

(87) PCT Pub. No.: WO03/070613

PCT Pub. Date: Aug. 28, 2003

(65) Prior Publication Data

US 2005/0127226 A1 Jun. 16, 2005

(30) Foreign Application Priority Data

Feb. 21, 2002 (IT) ..... BS2002A0014
Oct. 22, 2002 (IT) ..... BS2002A0097

(51) Int. Cl.
*B65H 51/20* (2006.01)

(52) U.S. Cl. ..... 242/364.8; 242/365; 242/65.1

(58) Field of Classification Search ..... 242/365.1, 242/364.8, 364.7, 365, 364.12, 365.3
See application file for complete search history.

(56) References Cited

U.S. PATENT DOCUMENTS 3,796,385 A * 3/1974 Jacobsson ..... 242/364.7
5,489,068 A * 2/1996 Vischiani ..... 242/365.1

FOREIGN PATENT DOCUMENTS

| | | | |
|---|---|---|---|
| CH | 381 622 | | 10/1964 |
| DE | 38 22 309 | | 1/1990 |
| DE | 3822309 A | * | 1/1990 |
| EP | 0 829 442 | | 3/1998 |

* cited by examiner

*Primary Examiner*—Kathy Matecki
*Assistant Examiner*—William E. Dondero
(74) *Attorney, Agent, or Firm*—McGlew & Tuttle, PC

(57) ABSTRACT

An accumulator-feeder device for feeding yarn to a textile, knitting and stocking machines with a winding drum turning around a rotating axis and composed of two connected cage rotors, opposite each other, each rotor having a head from which rods protrude facing the head of the other rotor. Rods of the two rotors form peripherally corresponding cylindrical surfaces; a first rotor rests on the rotating axis, the second rotor is oscillating on an axis at right angles to the rotating axis; the peripheral surface of the first rotor has an axis which coincides with the rotating axis of the winding drum, the peripheral surface of the second rotor has an axis inclined to the rotating axis, the peripheral surface protrudes from two diagonally opposite parts of the peripheral surface forming two conical lobes adjacent to the opposite heads of the drum.

11 Claims, 5 Drawing Sheets

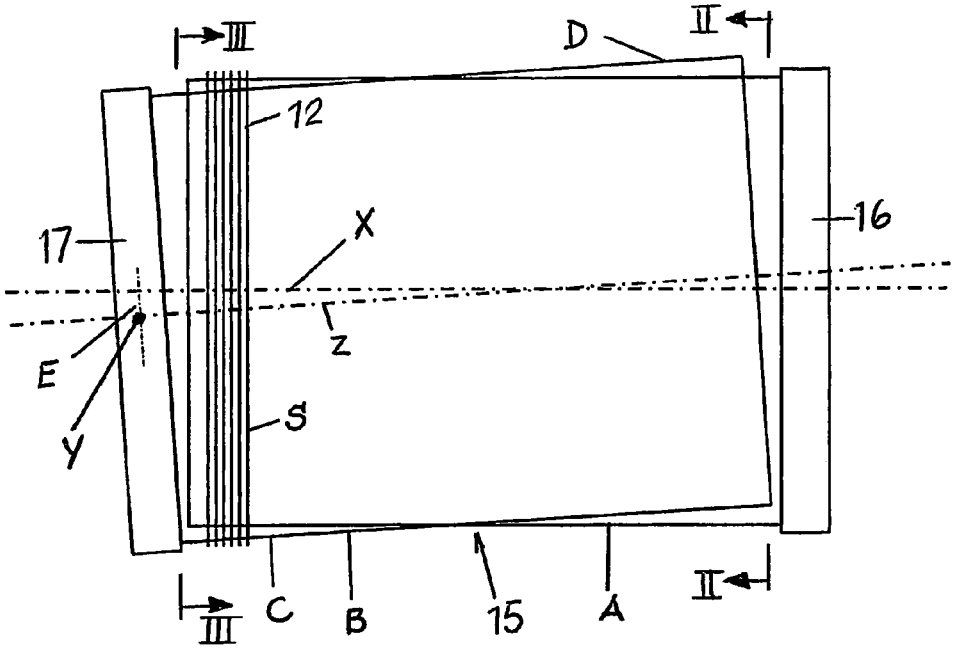
FIG. 1
FIG. 3
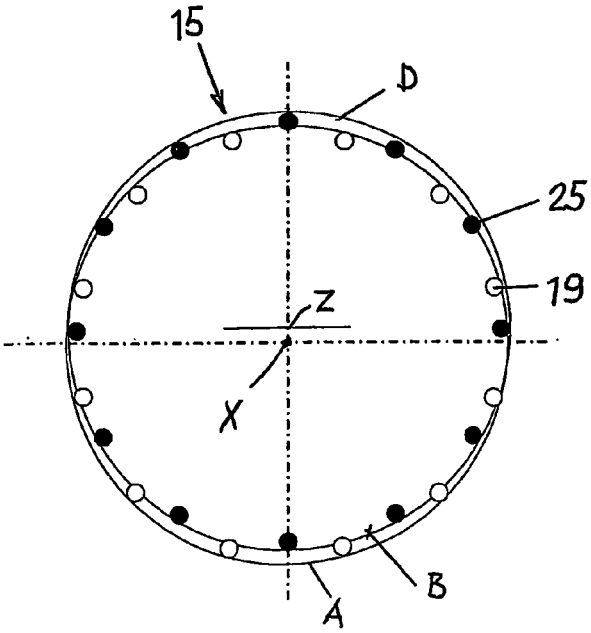
FIG. 2
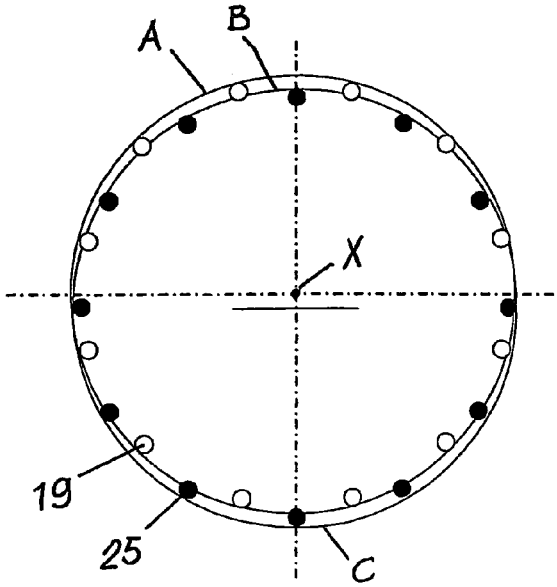

SEPARATED YARN COILS ACCUMULATOR-FEEDER

This application is a United States National Phase application of International Application PCT/IT/03/00084 and claims the benefit of priority under 35 U.S.C. § 119 of Italian Application BS2002A000014 filed Feb. 21, 2002, and Italian Application BS2002A000097 filed on Oct. 22, 2002, the entire contents of which are incorporated herein by reference.

FIELD OF INVENTION

This invention concerns a yarn accumulator-feeder to be used for supplying yarn to textile, knitting, stocking machines and the similar.

STATE OF THE ART

Yarn accumulator-feeders for the abovementioned use whether positive types, where the yarn wound on the device is supplied continuously to a textile machine in a pre-set quantity as regards to length and/or period of time or the passive type, where a textile machine draws the yarn from the device according to needs, even if not continuously, are already well known.

According to one method, a yarn accumulator-feeder includes a rotating drum around which the yarn is wound, gathering up to a certain quantity as coils. A feeder of this type uses an inclined disk to form the coils of yarn by pushing the coils of yarn progressively forward onto the drum as it turns.

Another method has a yarn feeder with a fixed drum and the yarn is wound round it by a turning yarn guide ring associated with an oscillating-translating device having rods which are intercalated and move between other rods which form the drum. This device is able to move the yarn forward gradually, accumulating it in the form of coils on the fixed drum. This method is complicated and costly and because of the fixed drum the accumulator can only be passive.

Also well known, for example from document CH-A-381 622, is a yarn feeder device of the type considered here which is made up of a rotating drum with two cage rotors, which turn together having peripheral fins or columns to receive the coils of yarn. The fins of a rotor are intercalated between the fins of the other rotor and the axes of the rotors are positioned obliquely one to the other so that the fins of one rotor emerge radially from only one part of the fins of the other rotor.

The abovementioned yarn accumulators are then usually equipped with mechanisms to stop the device when the yarn has accumulated to the set quantity and to restart it again when the quantity of yarn on the drum reaches the minimum set.

However, if as often happens, the coils of yarn are very close to each other or even tend to overlap one another, problems of correct feed of the yarn to a textile machine arise causing defects in the evenness in the fabric produced to the detriment of the its quality. In fact any variation in the resistance to the formation of the coils of yarn from the drum accumulator can cause micro-tears on the yarn itself which, given the high production speed and the inertia involved, may become important and cause variations in the tension of the yarn being fed to the machine itself and consequently important differences in work conditions of the yarn on this machine.

A proposal was also put forward to place a protective annular element around a yarn drum winder to prevent the yarn slipping off and tears in the yarn due to rotation and stopping and starting of the drum itself. According to the known technique however the protective element was placed only around one part of a winder drum and in addition it has never been used and the suggestion to apply it on an accumulator-winder of the type under consideration here has never been suggested, therefore this can still give problems and functional defects related to adherence of the coils of yarn to its surfaces.

OBJECTIVES AND SUMMARY OF THE INVENTION

One objective of this invention is to solve the functional defects intrinsic to yarn accumulator-feeders, by removing the causes which can lead to unwanted micro-tears of the yarn.

Another objective of the invention is to propose a yarn accumulator-feeder for textile machines capable of winding on and gathering coils of yarn on a turning drum in an orderly, separate fashion because they never interfere with each other while being wound.

Still another objective of the invention is to supply a device capable of winding on and gathering separated coils of yarn at a different speed according to needs, in controllable quantities so as to manage the amount of yarn available.

A further objective of the invention is to supply a yarn accumulator with an automatic stop winding-on system when the set amount has been reached and a restart of the machine, once again automatic, as soon as the coils of yarn available reach the preset minimum.

Another objective of the invention is to supply a yarn accumulator-feeder device with an automatic stop and start system controlled by the same organ used to form the separated coils of yarn and having a variable speed winder drum.

Another objective of the invention is to offer a yarn accumulator-feeder which can be used both as a positive and passive feeder for textile machines.

Another objective of the invention is to associate a protective, external element turning with the drum itself and enclosing the rotors for almost all their length, with a yarn accumulator-feeder device.

These objectives are reached, according to the invention, by a yarn accumulator-feeder device made up of a winder drum turning around a rotating axis, some methods of carrying the yarn to said drum and some methods of sending the yarn to the textile machine needing supplying, where the winder drum is made up of two associated cage rotors, facing each other, and each rotor having a head from which rods protrude towards the head of the other rotor and intercalated with the rods of the same. The rods of said two rotors form peripheral corresponding cylindrical surfaces; a first rotor lies on said rotating axis, whereas the second rotor oscillates on an axis at a right angle to the rotating axis, external to this rotating axis plane and connected to the head of second rotor; the peripheral surface of the first rotor has an axis which coincides with the rotating axis of the winder drum, whereas the peripheral surface of the other rotor has an axis inclined compared with the rotating axis starting from said oscillating axis; and the cylindrical peripheral surface of the oscillating rotor is inclined compared with the peripheral cylindrical surface of the other rotor and intersects with the latter in an intermediate part of the drum so that the peripheral surface of the oscillating rotor protrudes from two diagonally opposite parts of the peripheral surface of the first rotor, forming two conical lobes adjacent to the opposite heads of the drum and protruding depending on the inclination of the oscillating rotor in respect to the first rotor.

BRIEF DESCRIPTION OF DRAWINGS

The invention will be described below in greater detail in reference to the enclosed indicative and non-limiting drawings, in which:

FIG. 1 shows, in a diagram which illustrates only the cylindrical surfaces formed by the rods, a schematic lateral view of the drum in its starting position for winding on the yarn in coils;

FIG. 2 shows, in a front view in direction of the arrows II—II in FIG. 1, the layout of the rods forming the first and second cylindrical surfaces of the drum;

FIG. 3 shows, in a view from the rear in direction of the arrows III—III in FIG. 1, the layout of the rods forming the first and second cylindrical surfaces of the drum;

DETAILED DESCRIPTION OF THE INVENTION

Figure 6:
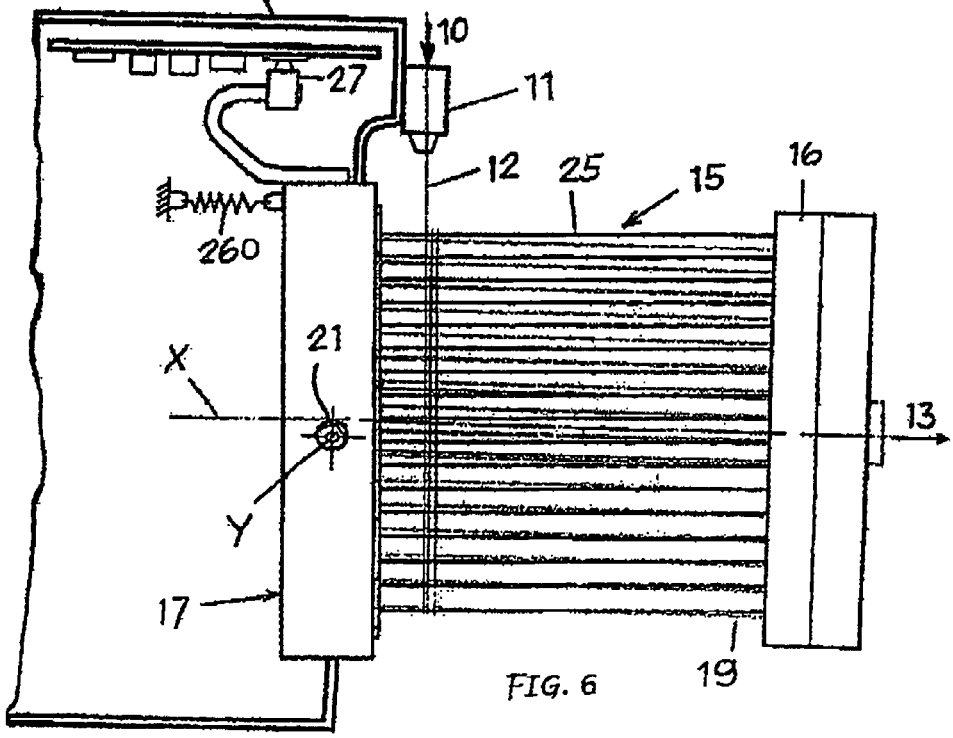
FIG. 6 is a schematic side view of the equipment of the invention.

The accumulator-feeder represented is equipped to receive, according to the direction of arrow 10, through the use of a fixed yarn guide 11, and accumulate in the form of coils S, a yarn 12 to be supplied to a user machine downstream, in an axial direction, according to arrow 13—FIG. 6—or in a lateral direction, at a tangent.

The accumulator is made up of a body 14 which holds a winding drum 15 turning on an rotating X axis, driven by a motor, not shown. To be more precise, the drum 15 is made up of two connected cage rotors turning contemporaneously.

In consideration of the formation direction of the coils S and consequently of the yarn on the drum, a first rotor has a front head 16 and the second rotor a rear head 17.

The front head 16 is keyed to a shaft 18, which coincides with the rotating X axis and is supported in the body 14 and turned by the equipment motor unit. The proximal ends of several rods 19 are fixed to the front head 16 spaced at an angle to each other, positioned around and parallel to the Rotating X axis of the drum. The rods 19 protrude towards the rear head 17 part of the second rotor, and together form a first cylindrical surface A—FIGS. 1–3. The distal ends, that is the ones not engaged, of rods 19 are inserted and hidden, without being constrained, in holes or slots 20 provided in the rear head 17—FIG. 7.

The rear head 17 of the second rotor is freely fitted on shaft 18 and can oscillate on Y axis thanks to its non-parallel geometry with the front head 16 and therefore sloping compared with the Rotating X axis. The Y oscillating axis can be set by two support pins 21, facing each other, connected to the body of the equipment—FIG. 6, 8. Furthermore the Y oscillating axis is not in the plane containing the Rotating X axis, but at an E adjustable distance, so the rear head 17 is also off-center, that is not coaxial in respect to the front head 16 and in the same way to the first cylindrical surface A.

Figure 7:
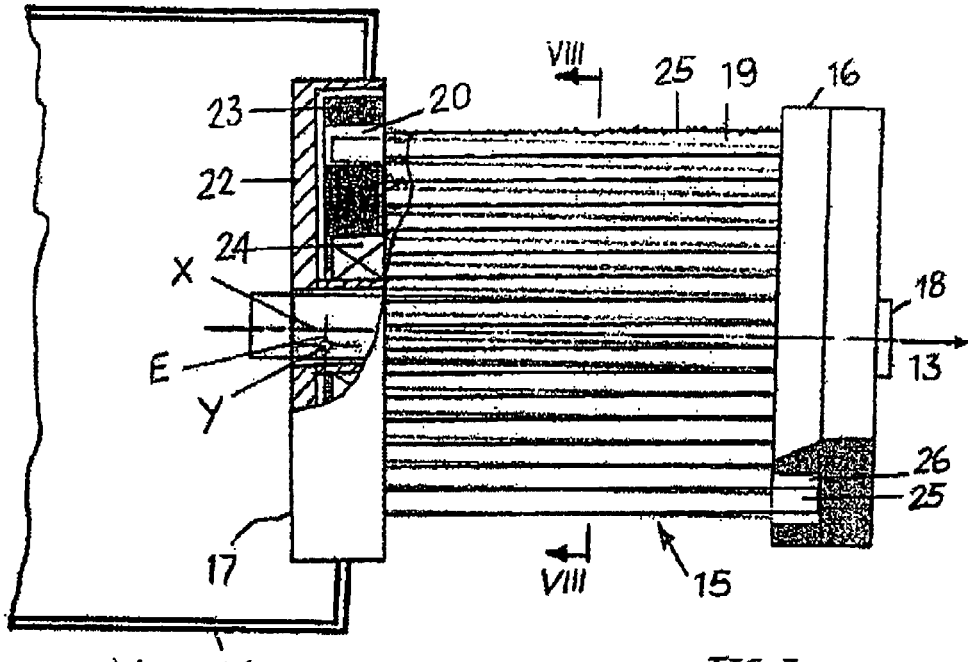
FIG. 7 shows a partial lengthwise cutaway view of the winder drum

In particular, the rear head 17—FIG. 7—is made up of an external fixed ring support 22, and by a rotating disk 23 connected to the ring support 22 and turning on a bearing 24. The fixed ring 23 is supported by opposite parts of the screw pins 21, whereas the turning disk 23 is made to turn by the front head by means of the rods 19 it supports and houses in the slots 20. Nonetheless, the ring support 22 and the rotating disk 23 can oscillate together in the Y axis described and move crossways and be positioned laterally on the directrix of said Y axis tightening and loosening the support screw pins as required. The support ring 22 may in addition be supported in any other way as long as it oscillates on the Y axis and moves laterally along this axis.

Other rods 25 are fixed to the rotating disk 23 of the rear head 17 which protrude towards the front head 16 in the spaces between the rods of the latter. The free ends of said rods 25 are inserted and hidden, without being constrained, in holes or slots 26 provided in the rear head. The second rods 25 oscillate together with the respective rear head and together form a second cylindrical surface B, FIGS. 1–3 which, given the inclination of the oscillating head 17, is at a slant compared with the cylindrical surface A at a Z axis. The first rods 19 and the second rods 25 can be cylindrical or any other shape.

The inclination of the rear head 17, and consequently the second rotor, can be limited as required and is usually held and reset by a return spring 26 connected to the ring support 22—FIG. 6.

An electric switch 27 of any type, is also associated with the ring 22, and is inserted into the electric circuit of the motor unit and set up to stop the latter when the quantity of coils of yarn on the drum has reached the maximum quantity established and to start it again when the quantity of coils of yarn the drum drops to the preset minimum. The switch is, and normally remains closed, while the rear head remains slanting held by the spring 26.

The most important feature of this winding drum 10 is that the first rotor lies on the Rotating X axis, whereas the second rotor (17, 25) is oscillating on the Y axis which is at right angles to the rotating X axis, but outside the plane containing this rotating axis and positioned at the height of the head 17 of the same second rotor. In the same way, the peripheral surface A of the first rotor has an axis which coincides with rotating axis X of the drum, whereas the peripheral surface B of the other rotor has a Z axis which is inclined in respect to the rotating X axis starting from the oscillating Y axis. In other words, the peripheral cylindrical surface B of the oscillating rotor is slanting In respect to the peripheral cylindrical surface A of the rotor and intersects with the former at an intermediate part of the drum. In this way, the peripheral surface B of the oscillating rotor protrudes from two diagonally opposite parts of the peripheral surface A of the other rotor forming two conical lobes C, D adjacent to the opposite heads of the drum.

Figure 8:
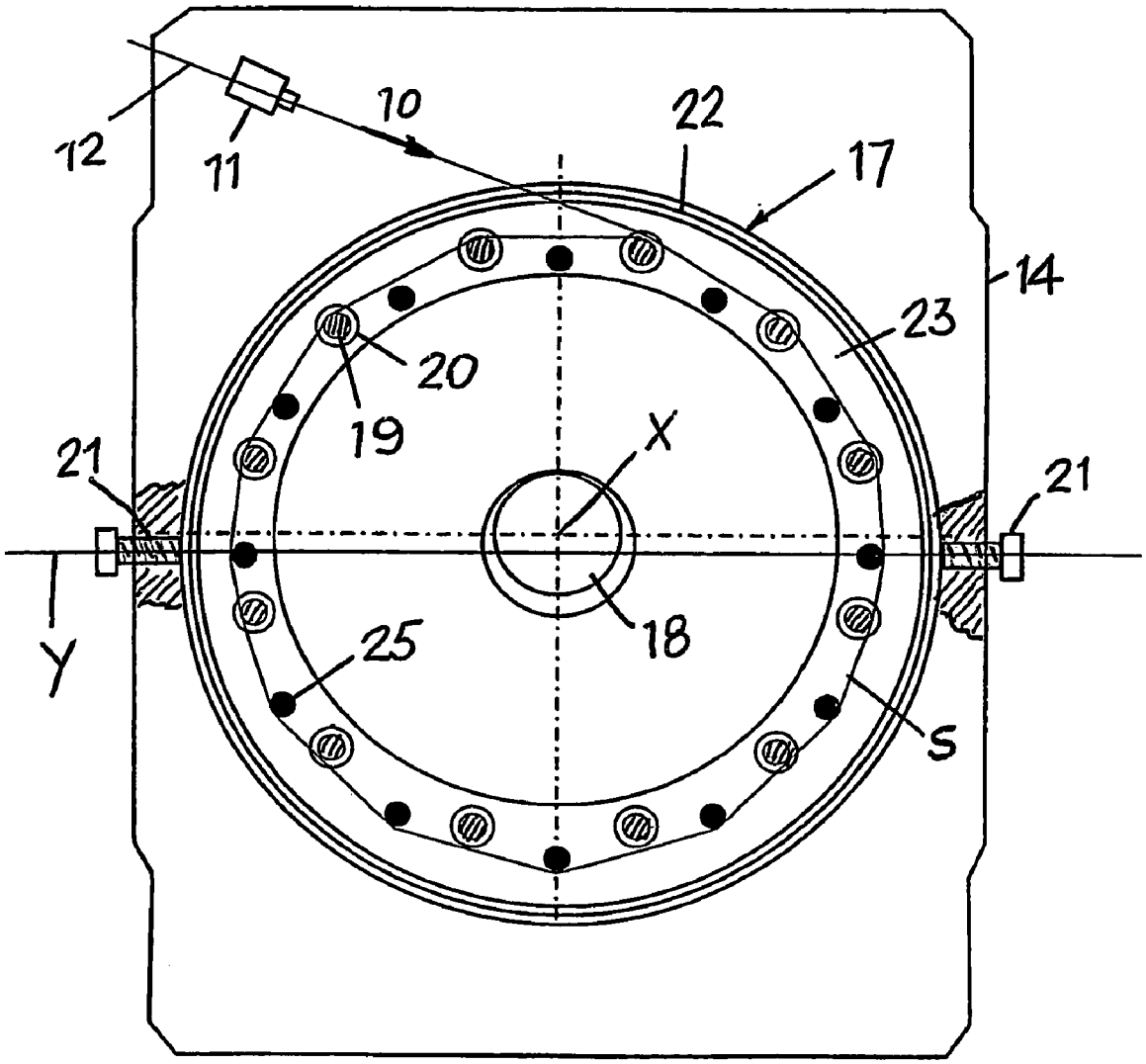
FIG. 8 shows a cross-section of the winder drum in direction of arrows VIII—VIII in FIG. 7.
Figure 9:
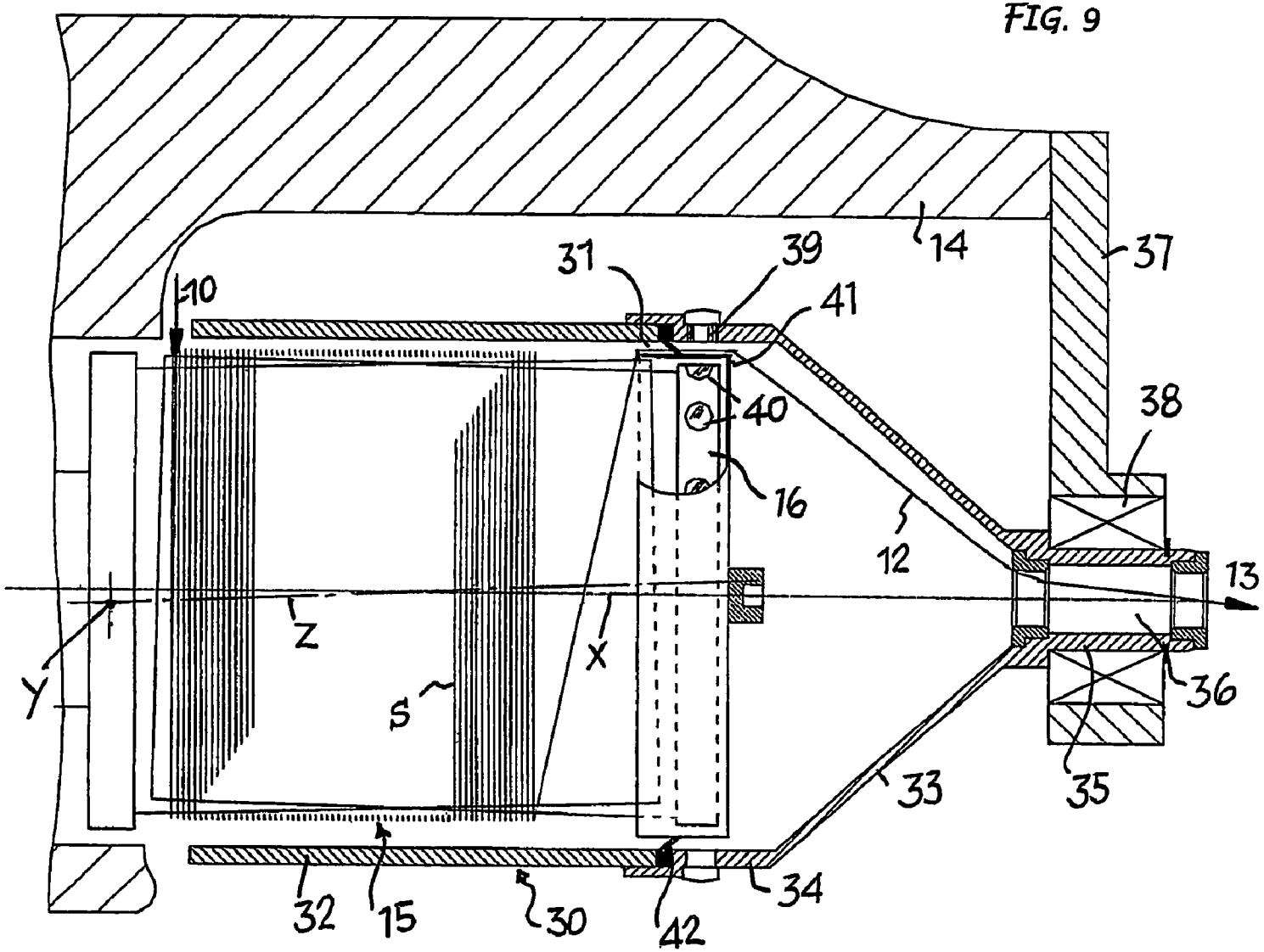
FIG. 9 shows an example of a winder drum enclosed in a protective element.

Examining the oscillating Y axis as shown in drawings—FIG. 8, the cylindrical surface B protrudes from the lower part of the rear section and from the top of the front section of cylindrical surface A, forming respectively the conical lobes C and D. These protrude at different lengths from the cylindrical surface A depending on the degree of eccentricity of the slant and lateral movement of the oscillating head 17 of the second rotor compared with the Rotating X axis of the drum, which coincides, as said above, with the axis of the first cylindrical surface A.

Consequently, the winding drum 15 in the part in line with the C and D lobes has an oval shape, formed in part by the cylindrical surface A and for the rest by cylindrical surface B the after being at an angle to the former. This configuration allows helicoidal winding of the yarn in separated coils fed gradually onto the drum starting from zone C adjacent to the rear head and moving towards zone D near the front head.

Figure 5:
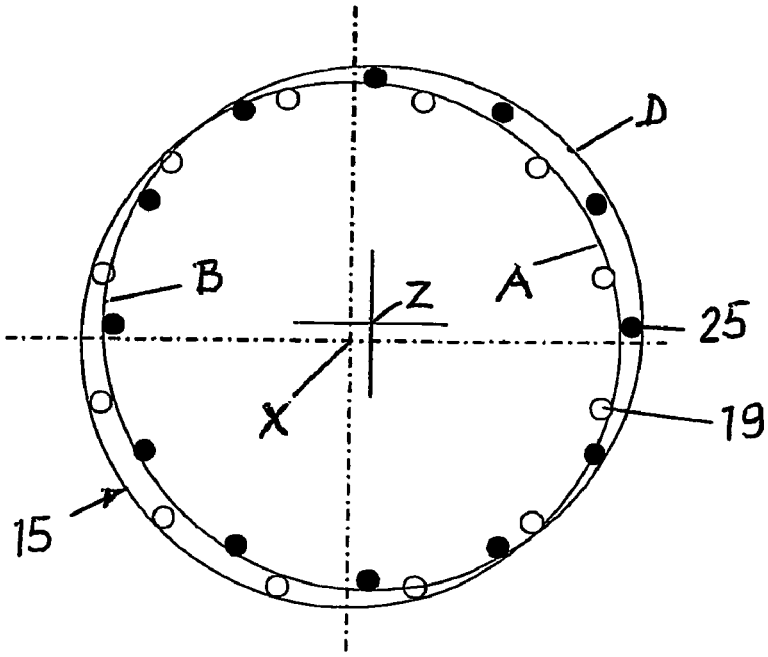
FIG. 5 is a similar view to the one in FIG. 2, but with the rods forming the reclining cylindrical surface moved to one side compared with the other rods.

The spacing between the coils of yarn depends on the slant, eccentricity and lateral movement of the rear head of the second rotor with respect to the rotating X axis and may be changed according to choice/limiting as required the values of these parameters—FIG. 5.

Advantageously, for a uniform and regular disposition of the coils of yarn according to a set spacing along all the length of the winding drum, the external surface of the rods 19, 25, which form the winding surfaces A and B, is rough or more precisely grooved crosswise to form small dips the coils of yarn slot into without them being able to slide and/or overlap.

Figure 4:
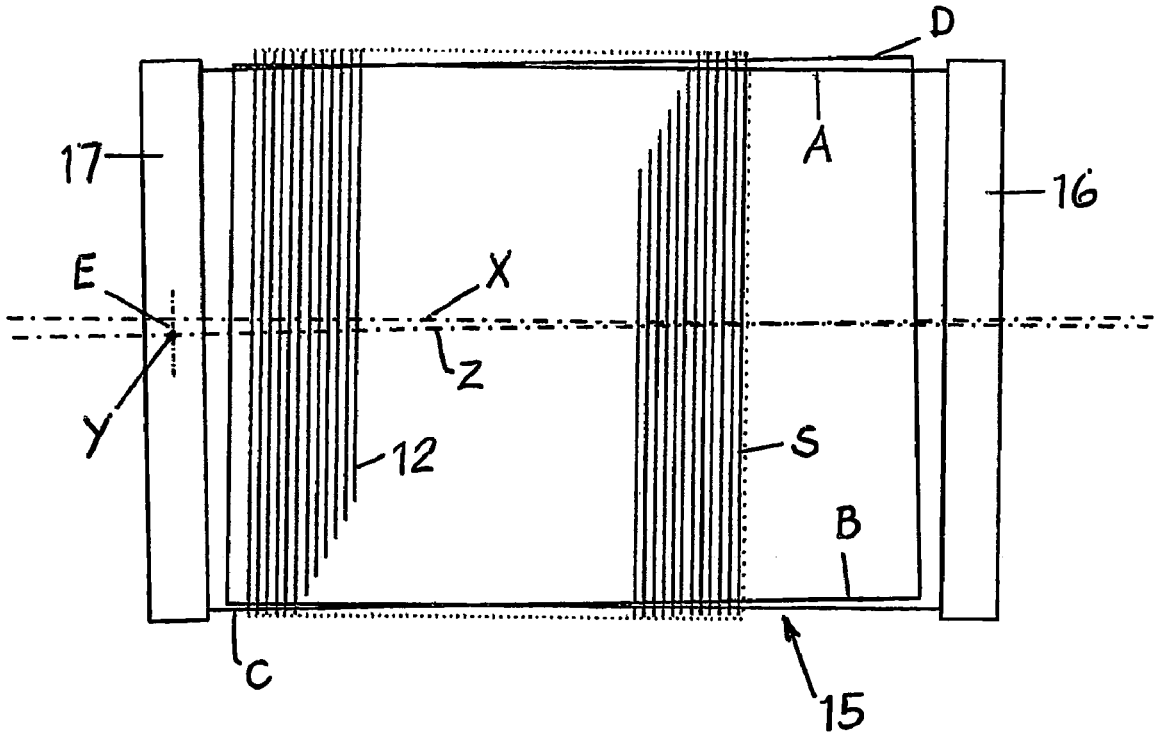
FIG. 4 is a schematic view similar to the one in FIG. 1, but with the drum having finished winding on the set amount of coils of yarn.

As they gradually move along on the drum, the coils of yarn exercise a radial force on the slanting rods 25 forming surface B which tends to make them return into the shape of the cylindrical surface A formed by said rods 19. This radial force, at lobe C would tends to increase the inclination of the oscillating head 17 and consequently of the rods 25. This is however avoided by the stop which limits the maximum slant of said oscillating head. On the other hand, the radial force exercised by the coils of yarn in the lobe D zone due to the lever effect with fulcrum over the oscillating Y axis obliges the rods 25 to at least partially return into the shape of the rods 19, that is of the cylindrical surface A they form, overcoming the force of the spring 26 and obliging the rear head 17 to oscillate on the Y axis and to straighten towards a position at right angles to the rotating X axis, as shown in FIG. 4.

When the quantity of coils of yam wound on the drum has reached the preset amount, the rear head 17 has straightened out sufficiently to cause the switch 27 to open and stop the drum. The yarn can still be wound off by th user machine, and when the coils on the drum have decreased to the preset minimum, the combined action of the return spring 260 and the radial force exercised by the coils of yarn in correspondence with lobe C will make the oscillating head 17 return to the start slanting position, in the same way the rods of the switch 27 fixed to it and the cylindrical surface B they form, causing at the same time the switch 27 to close to restart the equipment for a fresh winding cycle of the separated coils of yarn.

According to another aspect of the invention, the winding drum 15 is peripherally and for much of its length, enclosed in a turning protective element 30 the task of which is to hold the coils of yarn on the drum. The protective element 30 works in conjunction with and turn together with the drum 15 without there being any contact with it and forming with the said drum a round passage 31 for the yarn to pass through towards the textile machine needing feeding.

The protective element 30 is made up for the most part of a sleeve 32 surrounding the drum and a supporting element 33 on the non engaged end of the drum itself. The cylindrical sleeve 32 is preferably made of a transparent material. The supporting element 33 has an annular section 34 which encloses at least the head 16 at the front free end of the drum and which is attached, in a way so that it can be separated, to an adjoining end of the cylindrical sleeve 32. Starting from the annular section 34, the supporting element narrows conically until it ends in a tapered neck 35 which finishes at the rotating axis of the drum and which forms a central hole 36 for the yarn 12 to pass through towards the textile machine in the direction of arrow 13.

The protective element 30 is attached to the body of the device by means of an arm 37 which engages with the neck 35 of the supporting element 33 with interposition of bearings 38. The arm 37 can slide and turn with the body of the device so as to enable access to the winding drum by moving the protective element, both axially in respect to the drum and sideways when it is slipped out.

The protective element 30 is made to turn directly by the winding drum 15 by means of protruding magnetic elements 39, 40 interacting with each other. These magnetic elements are placed inside the annular section 35 of the supporting element 33 and on the outside of the head 16 at the free end of the drum 15.

Preferably, the magnets 40 applied to the head 16 are enclosed and protected by a hood 41 which does not effect the magnetic field, so as to avoid wear of the surface due to the yarn passing through. This hood is applied to the head 16 and extends axially beyond the adjoining part of the rods 19, 25 of the rotors to eliminate steps or hitches for the yarn where the rods of a rotor protrude at the side of the rods of the other rotor.

Furthermore a flexible braking fixture 42 in the shape of a comb or annular brush with teeth or bristles slanting facing and resting against the hood 41 can be assembled inside the protective element 30.

The invention claimed is:

1. An accumulator-feeder device for accumulating separated coils of yarn to be fed to a textile, knitting and stocking machines, comprising:

a winding drum (15) turning around a rotating axis (X), means for providing the yarn to said drum and means for furnishing the yarn to the textile machine needing feeding, where the winding drum (15) is composed of two connected cage rotors, opposite each other, each rotor having a head (16, 17) from which rods (19,25) protrude facing towards the head of the other rotor and intercalated with the rods of the latter, characterized byte fact that the rods of said two rotors form peripherally corresponding cylindrical surfaces (A, B); a first rotor rests on said rotating axis (X), whereas the second rotor is oscillating on an axis (Y) at right angles to the rotating axis (X), and outside the plane containing this rotating axis and positioned on a level the head (17) of said second rotor; the peripheral surface (A) of the first rotor has an axis which coincides with the rotating axis (X) of the winding drum, whereas the peripheral surface (B) of the second rotor has an axis (Z) inclined with respect to the rotating axis (X) starting from said oscillating axis (Y); and the peripheral cylindrical surface (B) of the oscillating rotor is on a slant with respect to the peripheral cylindrical surface (A) of the first rotor and intersects with the latter in an intermediate of the drum so that the peripheral surface (B) of the oscillating rotor protrudes from two diagonally opposite parts of the peripheral surface (A) of the other rotor forming two conical lobes (C, D) adjacent to the opposite heads (16, 17) of the drum and protruding depending on the inclination of an oscillating rotor in respect to the first rotor resting on the rotating axis (X), wherein an electric switch (27) is associated with the head (17) of the oscillating rotor, inserted in an electric circuit of a motor unit which drives the rotation of the drum, the electric switch being set up to start and stop drum turning in response to the oscillations of said oscillating head respectively between a first slanting position, corresponding to a minimum quantity of yarn on the drum, and a second slanting position, corresponding to a maximum quantity of coils of yarn on the drum, said first slanting position being set by a spring (26) and by a positive stop, said second position being set by a variation in the slant of the second cylindrical surface (B) caused by the yarn gathered on the drum.

2. A yarn accumulator-feeder device according to claim 1, wherein the head (17) of the oscillating rotor bearing the rods (25) forming the second cylindrical surface (B) of the drum is off-center in respect to the rotating axis (X).

3. A yarn accumulator-feeder device according to claim 2, wherein the head (17) the oscillating rotor is made up of a non-turning supporting external ring (22) and a rotating disk (23) associated with said supporting ring (22) with interposition of a bearing (24), and in which the supporting ring is supported by opposite parts of calibrating units (21) constituting the oscillating axis (Y) and means for lateral movements of the oscillating of head (17).

4. A yarn accumulator-feeder device according to claim 3, wherein the rods (19) on the first head (16) of the first rotor have their distal ends inserted freely in holes or slots in the rotating ring (23) of the oscillating rotor head (17), and the rods (25) carried by said oscillating rotor head (17) are inserted freely in holes or slots in the head (16) of the first rotor, this head (16) being fixed and turning with the rotating axis (X), whereas the rotating ring (23) of the oscillating rotor head (17) is driven to rotate by the head of the first rotor through the rods fixed to it.

5. A yarn accumulator-feeder device according to claim 1, wherein the rods (19, 25) forming the winding surfaces (A, B) of the coils of yarn have a peripheral surface with small dips formed by grooves running crossways.

6. A yarn accumulator-feeder device according to claim 1, further characterized by a protective element (30) associated, without physical contact and rotating with said winding device, said protective element being placed around the said drum to enclose it peripherally for the most part leaving an annular passage for the yarn, and by nearby drive means placed between the winding drum and the protective element so that they turn together.

7. A yarn accumulator-feeder device according to claim 6, wherein said drive means are made up of magnetic elements or means which can be magnetized (39,40) positioned opposite each other on board the winding drum and the protective element.

8. A yarn accumulator-feeder device according to claim 7, wherein the magnetic elements or means which can be magnetised are on board said annular section of the supporting element of the protective element, and said head of the first rotor at the free end of the drum, said magnetic elements or means which can be magnetised being enclosed in a protective hood (41) applied to said head.

9. A yarn accumulator-feeder device according to claim 6, wherein the protective element (30) includes a cylindrical sleeve (32) around the drum and a supporting element (33) holding said sleeve positioned on the free end of the drum, the supporting element (33) having an annular section (34) which surrounds at least the head of the first rotor at the free end of the drum and enabled to turn by a supporting arm.

10. A yarn accumulator-feeder device according to claim 9, wherein the supporting element (33) of the protective element is coupled in a separable way to a contiguous end wherein said cylindrical sleeve (32), and in which said supporting element, starting from its annular section (34) narrows conically ending in a tapered neck (35) which finishes at the rotating axis of the winding drum and which forms a central hole for the yarn to pass through towards the textile machine to be supplied, the supporting arm being associated with the neck (35) of the protective element.

11. A yarn accumulator-feeder device according to claim 6, wherein a flexible braking element made up of a comb or brush with teeth or bristles facing towards and resting on the protective hood (41) is positioned between the cylindrical sleeve and the supporting element of the protective element (30).

* * * * *